US010845014B2

(12) United States Patent
Ray

(10) Patent No.: US 10,845,014 B2
(45) Date of Patent: Nov. 24, 2020

(54) MOUNTING FLANGE FOR FLAMELESS CANDLE WITH INTEGRATED FOUNTAIN

(71) Applicant: INNOVATIVE FOUNTAINS, INC., Denver, CO (US)

(72) Inventor: Brian Ray, Denver, CO (US)

(73) Assignee: INNOVATIVE FOUNTAINS, INC., Denver, CO (US)

( * ) Notice: Subject to any disclaimer, the term of this patent is extended or adjusted under 35 U.S.C. 154(b) by 0 days.

(21) Appl. No.: 16/395,664

(22) Filed: Apr. 26, 2019

(65) Prior Publication Data

US 2019/0338901 A1 Nov. 7, 2019

Related U.S. Application Data

(60) Provisional application No. 62/665,768, filed on May 2, 2018.

(51) Int. Cl.

| | |
|---|---|
| ***F21V 33/00*** | (2006.01) |
| ***F21S 10/04*** | (2006.01) |
| ***F21S 6/00*** | (2006.01) |
| ***F21S 10/00*** | (2006.01) |
| *F21S 9/02* | (2006.01) |
| *F21Y 115/10* | (2016.01) |
| *B05B 17/08* | (2006.01) |
| *F21W 121/02* | (2006.01) |

(52) U.S. Cl.

CPC ..... *F21S 6/001* (2013.01); *F21S 10/002* (2013.01); *B05B 17/08* (2013.01); *F21S 9/02* (2013.01); *F21W 2121/02* (2013.01); *F21Y 2115/10* (2016.08)

(58) Field of Classification Search

CPC ... B05B 17/08; F21S 9/02; F21S 6/001; F21S 10/002

See application file for complete search history.

(56) References Cited

U.S. PATENT DOCUMENTS 3,702,172 A * 11/1972 Hawkins ..... F21S 8/00 239/18
4,205,785 A * 6/1980 Stanley ..... A63H 23/16 239/17
4,280,297 A * 7/1981 Katzman ..... A63H 33/28 446/183
5,299,588 A * 4/1994 MacLeod ..... A45B 11/00 135/16

(Continued)

FOREIGN PATENT DOCUMENTS

CN 205929964 U 2/2017

OTHER PUBLICATIONS

PCT Search Report from corresponding PCT Application No. PCT/US2019/029369, dated Aug. 8, 2019.

(Continued)

*Primary Examiner* — Arman B Fallahkhair
(74) *Attorney, Agent, or Firm* — Holzer Patel Drennan

(57) ABSTRACT

Implementations herein provide a flameless candle with an integrated fountain including an outer shell and a removable core. The removable core is removably connected to the outer shell and includes a flange configured to rest on a top portion of the outer shell. The removable core also includes a dome with a serrated bottom edge, a liquid pump, and a light source.

20 Claims, 7 Drawing Sheets

(56) References Cited

U.S. PATENT DOCUMENTS

| | | | | |
|---|---|---|---|---|
| 6,161,771 | A * | 12/2000 | Henry | A63G 31/007 239/17 |
| 6,382,520 | B1 * | 5/2002 | Hones | B05B 1/044 239/12 |
| 6,790,033 | B2 * | 9/2004 | Grady | F24B 1/181 126/500 |
| 9,080,762 | B2 | 7/2015 | Ray | |
| 9,115,884 | B2 * | 8/2015 | White | F23D 3/26 |
| 9,643,204 | B2 | 5/2017 | Ray | |
| 10,132,454 | B2 * | 11/2018 | Li | F21S 9/02 |
| 2002/0164554 | A1 * | 11/2002 | Kisch | F23D 3/02 431/298 |
| 2007/0053174 | A1 * | 3/2007 | Lin | B05B 17/08 362/96 |
| 2014/0117107 | A1 | 5/2014 | Vogtner et al. | |
| 2015/0276204 | A1 | 10/2015 | Ray | |
| 2016/0263613 | A1 | 9/2016 | Lin | |
| 2017/0067608 | A1 | 3/2017 | Patton | |
| 2019/0203926 | A1 * | 7/2019 | Lin | F21S 10/04 |

OTHER PUBLICATIONS

PCT Written Opinion from corresponding PCT Application No. PCT/US2019/029369, dated Aug. 8, 2019.

Scentsy Diffusers, https://scentsy.com/shop/c/4435/diffusers, accessed Apr. 26, 2019.

* cited by examiner

MOUNTING FLANGE FOR FLAMELESS CANDLE WITH INTEGRATED FOUNTAIN

CROSS-REFERENCE TO RELATED APPLICATIONS

The present application claims benefit of priority to U.S. Provisional Patent Application No. 62/665,768, entitled "MOUNTING FLANGE FOR FLAMELESS CANDLE WITH INTEGRATED FOUNTAIN" and filed on May 2, 2018, which is specifically incorporated by reference herein for all that it discloses or teaches.

BACKGROUND

A flameless candle with an integrated fountain combines the decorative effect of a candle with the soothing properties of a water feature in a self-contained, portable unit. However, current flameless candles with integrated fountains may cause undesirable splashing, loss of falling water effect sounds, and be difficult and expensive to change if desired.

SUMMARY

Implementations herein provide a flameless candle with an integrated fountain including an outer shell and a removable core. The removable core is removably connected to the outer shell and includes a flange configured to rest on a top portion of the outer shell or other supporting structure of the flameless candle. The removable core also includes a dome with a serrated bottom edge, a liquid pump, and a light source.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

DETAILED DESCRIPTIONS

Figure 1:
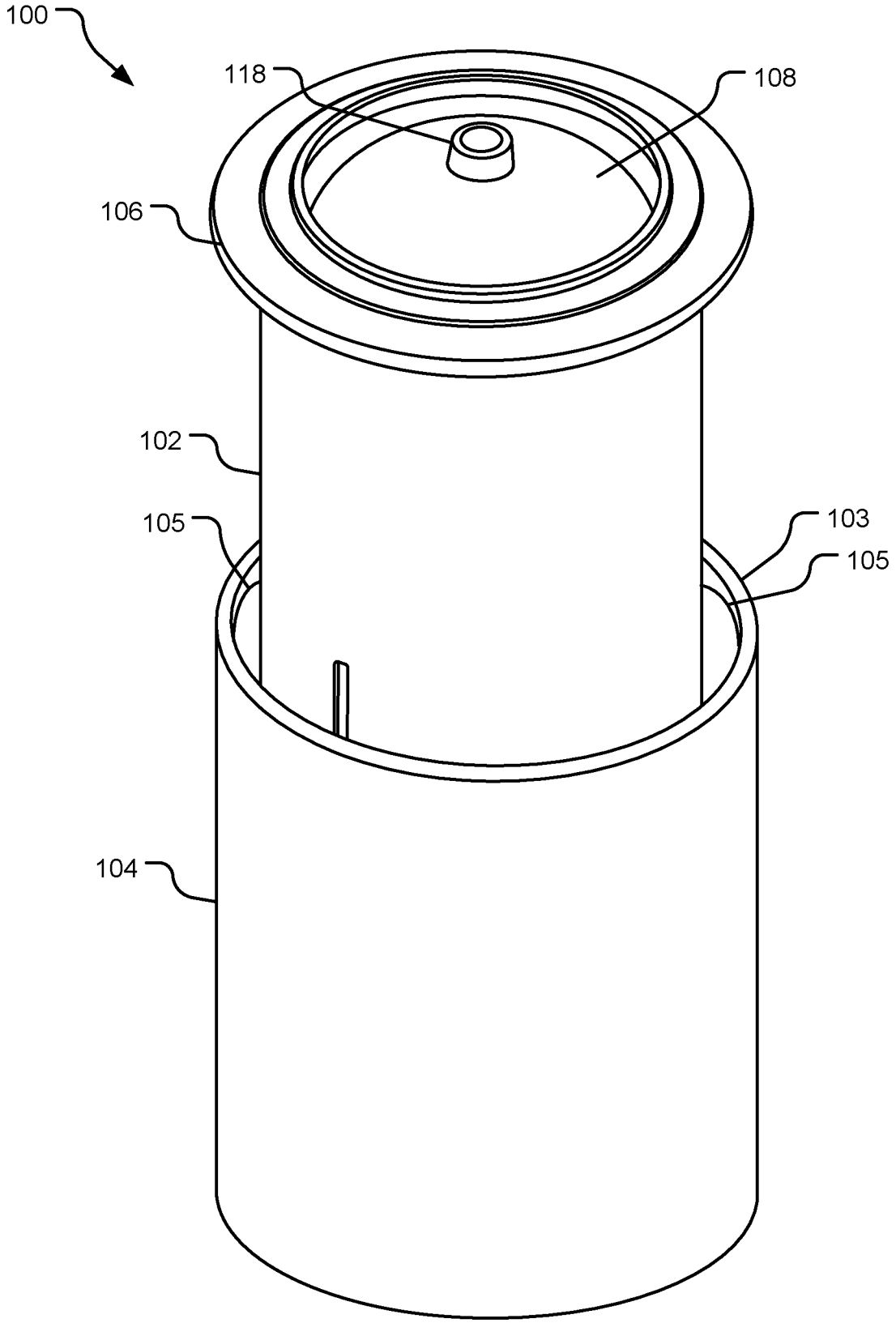
FIG. 1 illustrates an example perspective view of a flameless candle with an integrated fountain.

FIG. 1 illustrates an example perspective view of a flameless candle with an integrated fountain 100. The flameless candle with integrated fountain 100 includes a removable core 102 that fits inside a supporting structure (e.g., an outer shell 104 or a bracket containing a supporting ring or other physical structure). A flange 106 on the removable core 102 allows the removable core 102 to rest on a top edge 103 of the outer shell 104 such that the removable core 102 is suspended within the outer shell 104. The removable core 102 includes the mechanical and electrical components of the flameless candle and the integrated fountain 100. The outer shell 104 provides a decorative element. Because the removable core 102 is separate from the outer shell 104, it is possible to quickly and inexpensively change the visual appearance of the flameless candle with the integrated fountain 100 by placing the removable core 102 into a different outer shell 104.

The outer shell 104 may be made from a variety of materials. In one implementation, the outer shell 104 is made from translucent glass. The surface of the translucent glass may include etching or other designs. The outer shell 104 may also be made from, without limitation, plastic, wax, or another translucent or transparent material. When the outer shell 104 is made from wax, clearance created between the removable core 102 and the outer shell 104 allows the outer shell 104 to contract in the cold without cracking. Further, the outer shell 104 may be shaped and colored to resemble a traditional wax candle.

The outer shell 104 may be a variety of shapes as well. In one implementation, the outer shell 104 is a cylinder with a constant circular cross-section. In another implementation, the outer shell 104 has a circular cross-section that varies in diameter along the height of the outer shell 104. In other implementations, the outer shell 104 may have a variety of shapes of cross-sections, including, without limitation, a square, a triangle, or another polygon shape.

The removable core 102 contains functional components of the flameless candle with integrated fountain 100. The components of the removable core 102 are discussed in more detail with respect to FIG. 3, but may include an upper reservoir, a lower reservoir, a submersible pump, a power source, light emitting diodes (LEDs), the flange 106 and a serrated dome 108.

In various implementations, the removable core 302 includes a supporting structure for supporting the removable core 302 suspended within the outer shell. In some implementations, a top edge 103 of the outer shell 104 is the supporting structure.

The flange 106 of the removable core 102 allows the removable core 102 to rest suspended within the outer shell 104. When the removable core 102 is placed within the outer shell 104, the flange 106 rests on the top edge 103 of the outer shell 104. The flange 106 may be a variety of sizes to accommodate moving the removable core 102 between different outer shells 104. To facilitate the interchangeability of outer shells, in one implementation, the flange 106 is removable so that flanges of different sizes and shapes may be used for different outer shells 104. For example, the flange 106 may include threads and screw onto the removable core 102. To use the removable core 102 with an outer shell with a larger diameter than the outer shell 104, the flange 106 could be removed and be replaced with another flange with a larger outer diameter. Similarly, to use the removable core 102 with an outer shell with a different cross-sectional shape, the flange 106 could be removed and be replaced with another flange with an appropriate matching cross-sectional shape.

In other implementations, an inner ring 105 protrudes from an interior of the outer shell 104 and serves as the supporting structure, wherein the flange 106 fits within the outer shell and below the top edge 103 and rests on the inner ring 105.

The flange 106 may also act as a splash guard for water flowing over serrated dome 108. The serrated dome 108 includes a conduit 118 that attaches to an outlet of a submersible pump (not shown) located in the removable core 102. The serrated dome 108 also includes a serrated bottom edge (not shown). The serrated bottom edge of the serrated dome 108 enhances the sound of the water flowing over the serrated dome 108 by separating the water out into individual streams.

Figure 2:
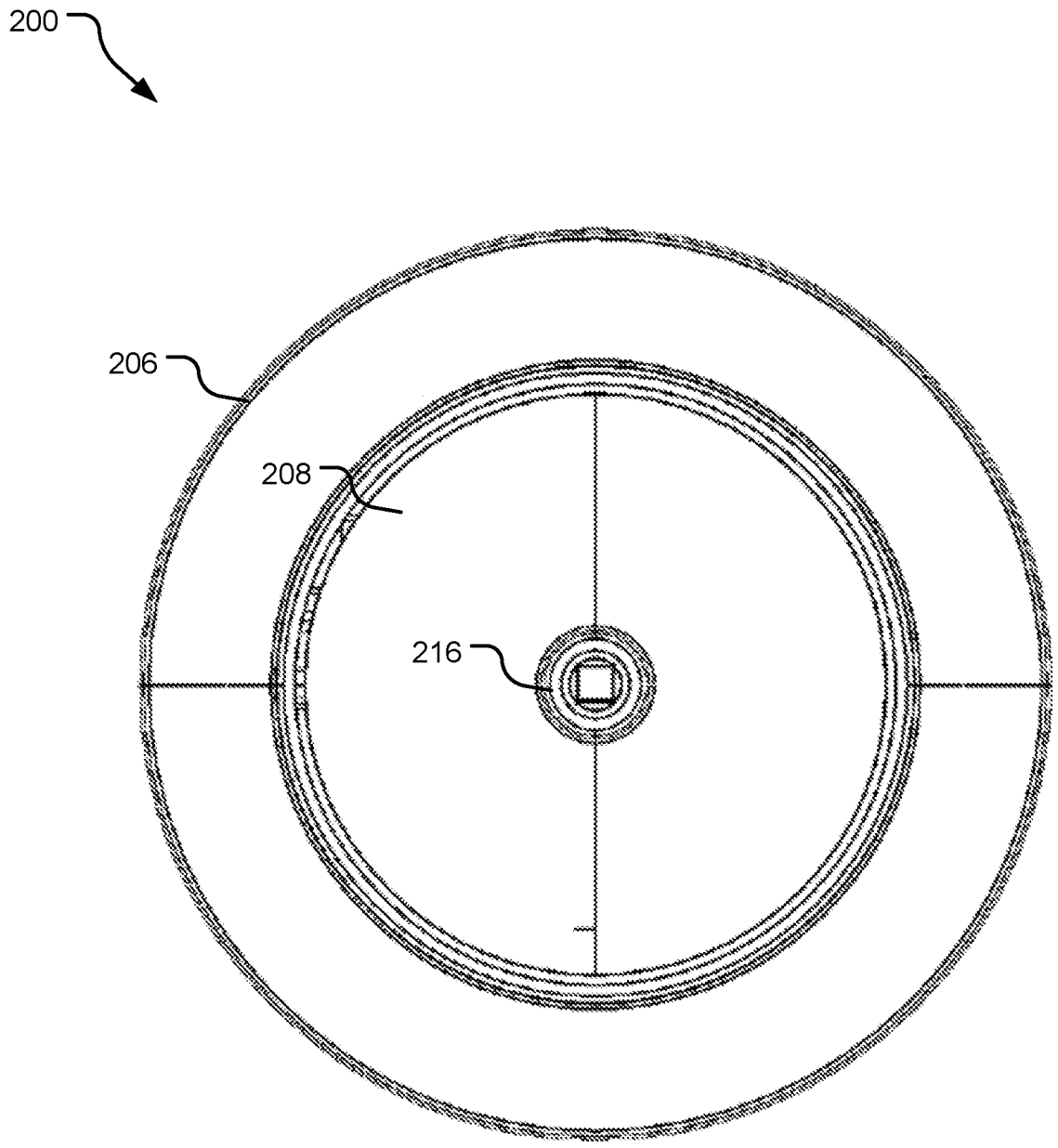
FIG. 2 illustrates a top view of an example flameless candle with an integrated fountain.

FIG. 2 illustrates a top view of an example flameless candle with an integrated fountain 200. The top view shows a flange 206 and a serrated dome 208. The serrated dome 208 disburses water going through the fountain portion of the flameless candle with the integrated fountain 200. The flange 206 allows a removable core of the flameless candle with the integrated fountain 200 to be suspended within an outer shell of the flameless candle with the integrated fountain 200 such that the flange rests on a top edge of the outer shell.

The serrated dome 208 includes a conduit 216 attached to an outlet of a pump within the removable core of the flameless candle with the integrated fountain 200 (not shown). The conduit 216 allows water to flow upward from the pump and over the serrated dome 208. The flange 206 also acts as a splash guard for water flowing over the serrated dome 208. The serrated dome 208 may have a smooth surface or may include surface features to alter the flow of water over the serrated dome 208. For example, the serrated dome 208 may include etching, divots, or raised portions to alter the flow of the water.

Figure 3:
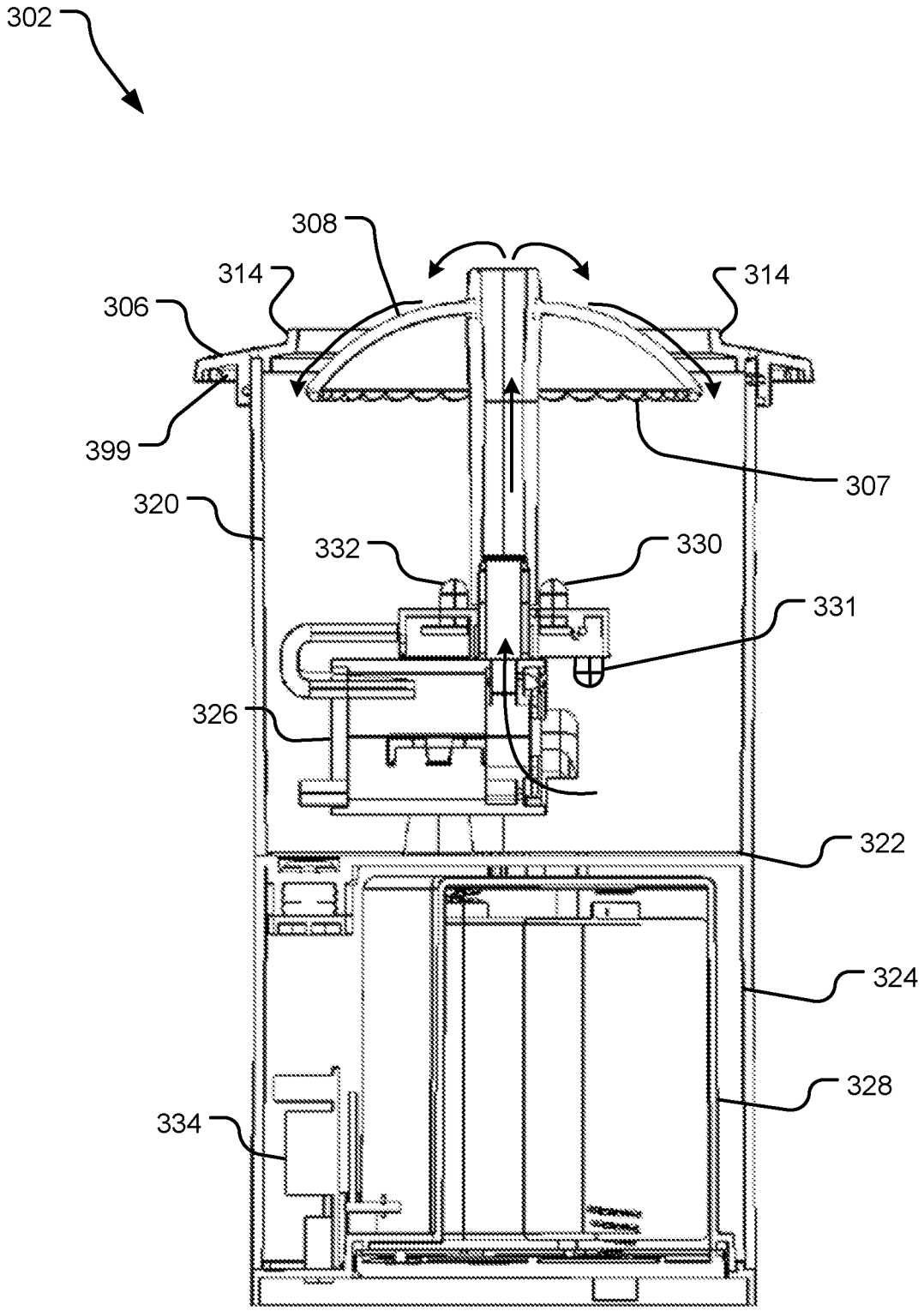
FIG. 3 illustrates an elevation section view of an example removable core of a flameless candle with an integrated fountain.

FIG. 3 illustrates an elevation section view of an example removable core 302 of a flameless candle with an integrated fountain. The removable core 302 includes components for both the flameless candle portion and the fountain portion of the flameless candle with integrated fountain. The removable core 302 may be operated independently or may be placed within a supporting structure (e.g., an outer shell or a handing bracket (not shown)) to provide a more decorative exterior to the flameless candle with the integrated fountain. The removable core 302 may be made from any suitable rigid water-proof material such as plastic. The removable core 302 may be made of translucent or transparent material, such that lighting inside the removable core 302 is visible from the outside of the flameless candle with the integrated fountain when the removable core 302 is inserted in an outer shell.

The removable core 302 includes a flange 306 and a serrated dome 308. The flange 306 allows the removable core 302 to hang suspended within the outer shell (not shown). The flange 306 also acts as a splash guard 314 for water flowing over the serrated dome 308. In some implementations, the flange 306 is removably attached to the removable core 302. When the flange 306 is removably attached, additional flanges may be included with the removable core 302 so that the removable core 302 may be suspended in a variety of different sized outer shells.

In some implementations, the serrated dome 308 may be removable from the remainder of the removable core 302 such that the removable core 302 may be used with a variety of serrated domes. For example, different serrated domes may be shaped differently, made of different materials, or provide different water patterns. The serrated dome 308 includes serration 307. The serration 307 causes water flowing over the serrated dome 308 to separate into individual streams.

Arrows in FIG. 3 show the flow path of water or other liquid through the removable core 302. The water or other liquid flows into a submersible pump 326. The submersible pump 326 then pumps the water or other liquid up and through a conduit of the serrated dome 308. The water or other liquid then flows over the upper portion of the serrated dome 308 and is separated into individual streams by the serration 307 of the serrated dome.

As shown in FIG. 3, the removable core 302 is separated into an upper reservoir 320 and a lower reservoir 324 by a divider 322. The lower reservoir 324 includes a power module 328 and the upper reservoir 320 includes the submersible pump 326 and LEDs 330 and 332. The upper reservoir 320 may be filled with water or another suitable fluid to operate the fountain portion of the flameless candle with integrated fountain. In some implementations, the upper reservoir 320 may include additional liners and gaskets to ensure that water in the upper reservoir 320 remains within the upper reservoir 320. The lower reservoir 324 is primarily sealed from the water in the upper reservoir 320 by the divider 322.

In some implementations, the water or other fluid in the upper reservoir 320 may include scented oils or other additives. In another implementation, the water or other fluid in the upper reservoir 320 may include an anti-freeze agent to keep the fluid from freezing if the flameless candle with the integrated fountain is exposed to low temperatures.

LEDs 330, 331, 332 provide illumination for water flowing over the serrated dome 308. In some implementations, additional LEDs may be located in the upper reservoir 320, facing upward, facing downward, or otherwise oriented. The LEDs 330 and 332 are located below the serrated dome 308 and oriented upward such that the LEDs illuminate water flowing over the serrated dome 308. The LED 331 is oriented downward to illuminate bottom portions of the removable core 302. The LEDs 330, 331, 332 may be adjustable to create different effects in the flameless candle with integrated fountain. For example, the LEDs 330 331, 332 may be dimmable. In one implementation, the LEDs 330 331, 332 may be capable of lighting in a variety of different colors.

The lower reservoir 324 includes electronic components that do not come in contact with water in the removable core 302. For example, the lower reservoir 324 may include the power module 328 and communications circuitry 334. The communications circuitry 334 may include wireless or radio receivers so that the removable core 302 may be controlled using a remote control. In another implementation, the communications circuitry 334 may include a switch to directly power the removable core 302 on and off.

In one implementation, the power module 328 includes batteries to power the removable core 302 of the flameless candle with integrated fountain. When the removable core 302 is powered by batteries, the power module 328 may be accessible from the bottom of the removable core 302 so that the batteries can be changed or recharged after use. In another implementation, the power module 328 includes electronic components for a plug so that the flameless candle with integrated fountain may be powered through a wall outlet or universal serial bus (USB) power source. The power module 328 may power various components of the removable core 302, including the LEDs 330, 331, 332 and the submersible pump 326. Further, in some implementations, the LEDs 330, 331, 332 are operable independent of the submersible pump 326 such that the removable core 302 may operate as only a flameless candle, only a fountain, or as a flameless candle with integrated fountain. The LEDs 330, 331, 332 may also be operated on a timer.

In some implementations, the removable core 302 may include a bottom cap (not shown) to seal, conceal, and/or provide selective access to functional components of the removable core 302. In various implementations, the bottom cap may be press fit, screwed, or otherwise snapped in place. The bottom cap may be permanently installed or removable by a user for service or maintenance.

Figure 4:
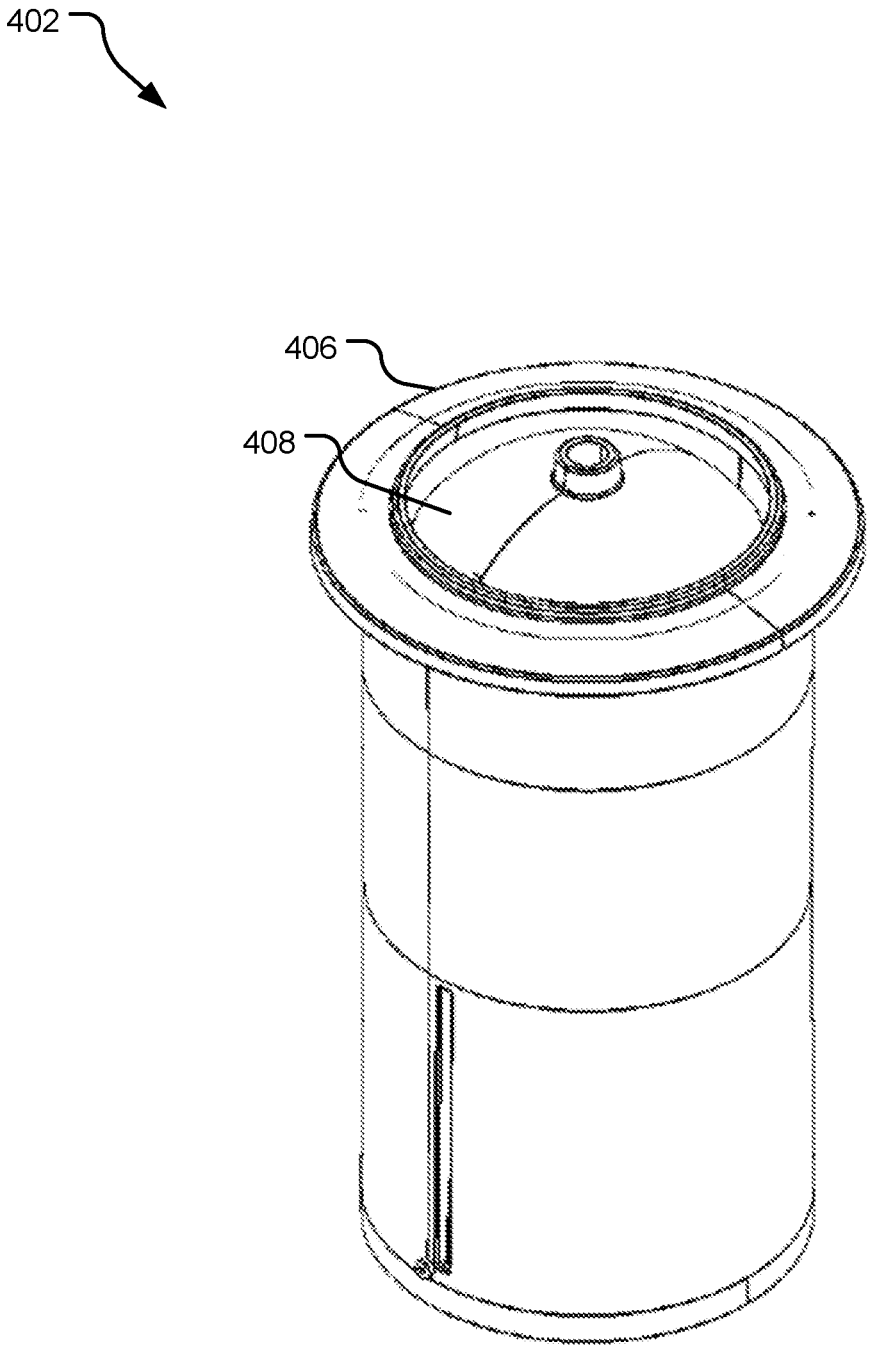
FIG. 4 illustrates a perspective view of an example removable core that forms part of a flameless candle with an integrated fountain.

FIG. 4 illustrates a perspective view of an example removable core 402 that forms part of a flameless candle with an integrated fountain. The removable core 402 includes functional components of a flameless candle with an integrated fountain, including, without limitation, a power module, LEDs, a submersible pump, a serrated dome 408 and a flange 406. As shown in FIG. 4, the removable core 402 is cylindrical. However, in other implementations, the removable core 402 may be shaped differently. For example, the removable core 402 may be, for example, a rectangular prism or a cube.

The flange 406 may be permanently attached or removably attached to the removable core 402. For example, in one implementation, the flange 406 includes threads so that the flange 406 screws onto the removable core 402. In other implementations, the flange 406 may attach to the inner core using other attachment mechanisms including, for example and without limitation, snaps, a bayonet type fastener, or a cantilever fastener. The flange 406 allows the removable core 402 to be suspended within an outer shell (not shown) by sitting on a top edge of the outer shell. The flange 406 may also act as a splash guard for water flowing over the serrated dome 408.

The flange 406 may be sized and shaped so that the removable core 402 may fit into a variety of outer shells. For example, the flange 406 may have a larger outer diameter when the outer shell is larger. In another implementation, the flange 406 may be square shaped so that the removable core 402 fits within a removable core that is a rectangular prism.

The serrated dome 408 is located within the removable core 402 such that water flows over the serrated dome 408. The serrated dome 408 is placed so that water flowing over the serrated dome 408 remains within the removable core 402 and the flange 406 acts as a splash guard for water flowing over the serrated dome 408.

Figure 5:
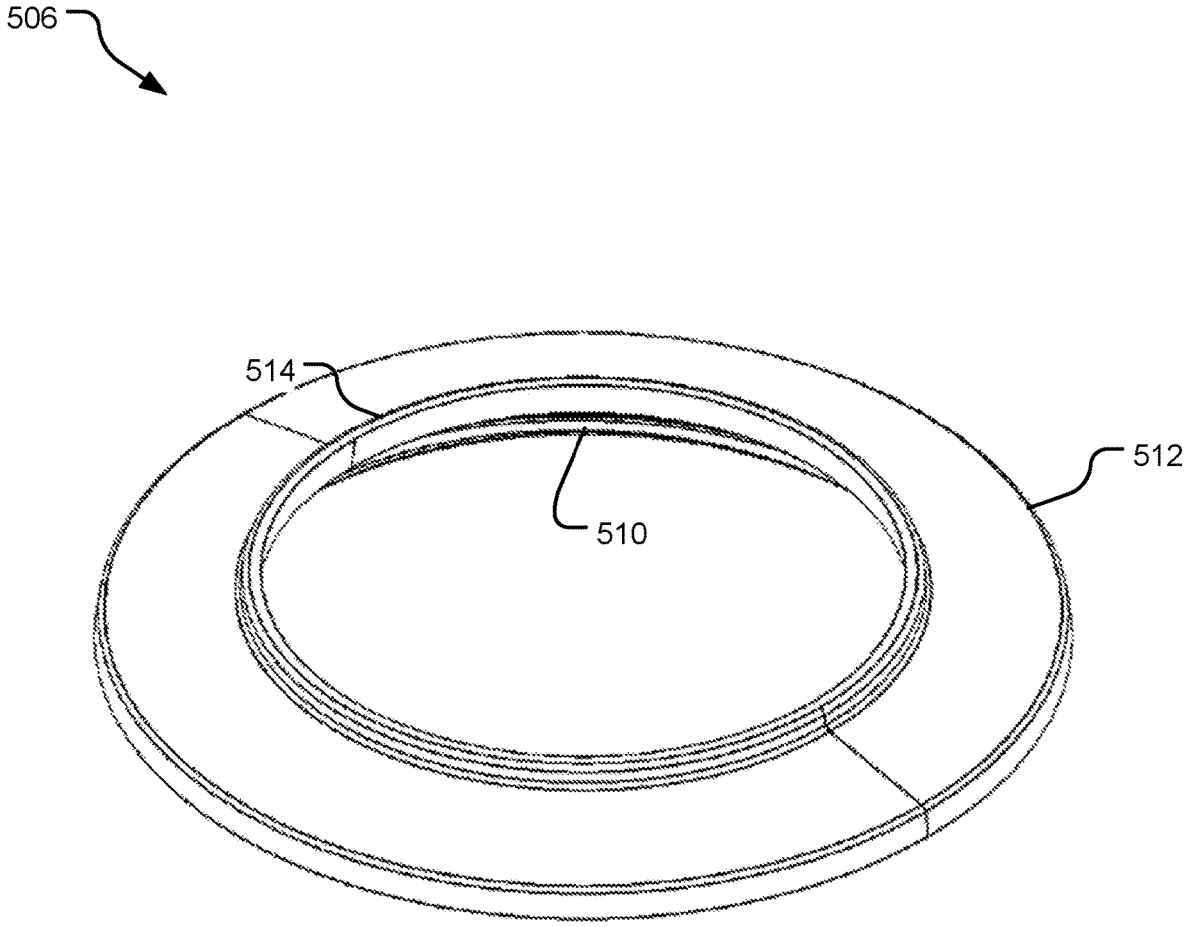
FIG. 5 illustrates a perspective view of an example flange for use with a flameless candle with an integrated fountain.

FIG. 5 illustrates a perspective view of an example flange 506 for use with a flameless candle with an integrated fountain. The flange 506 is fastened to the inner core of the flameless candle with the integrated fountain such that the flange 506 rests on a top portion of the outer shell when the inner core is placed in the outer shell. Further, the flange 506 allows the inner core to be suspended within the outer shell. The suspension of the inner core within the outer shell reduces the need for sealing between the inner core and the outer shell. Because there is clearance between the inner core and the outer shell, water does not leak between the inner core and the outer shell.

The flange 506 may be detachable from the remainder of the inner core or may be permanently attached to the inner core. The flange 506 shown in FIG. 5 is detachable from the inner core and attaches to the inner core using threads 510 located on the inner bottom portion of the flange 506. In other implementations, the flange 506 may attach to the inner core using other attachment mechanisms including, for example and without limitation, snaps, a bayonet type fastener, or a cantilever fastener.

The flange 506 may be a variety of shapes to accommodate differently shaped outer shells. For example, the flange 506 shown in FIG. 5 is circular to accommodate a cylindrical outer shell. In another implementation, the flange 506 may be, for example, an oval shape to accommodate an outer shell with an oval cross-section. Further, the outer portion 512 of the flange 506 may vary in size to accommodate a larger or smaller outer shell. For example, the outer portion 512 may have a larger outer diameter when the outer shell has a larger diameter. When the flange 506 is removable from the inner core, differently sized or shaped flanges may be used so that the same core may fit in multiple outer shells of different sizes and shapes. The outer portion 512 of the flange 506 may be tapered or non-tapered. Further, in some implementations, the outer portion 512 of the flange 506 may include a groove (see e.g., groove 399 of FIG. 3) on the underside to provide a seat for the outer shell. In other implementations, the outer portion 512 of the flange 506 may include multiple grooves to accommodate outer shells with different diameters using the same flange.

The flange 506 may be made from a variety of materials. In one implementation, the flange 506 is plastic and is manufactured using molding. In other implementations, the flange is made out of ceramic material, glass, pressed or molded non-combustible fiber, metallic materials, or wooden materials.

In addition to acting as a means of suspending the inner core inside of the outer shell, the flange 506 may also act as a splash guard for water inside of the inner core. The flange 506 is positioned on the inner core to allow enough space for water to flow over the dome while also providing a shield against water splashing out of the core and onto a desk or table top. In some implementations, the flange 506 includes an upper lip 514 that further prevents water from splashing out of the inner core.

While the flange 506 of FIG. 5 is depicted removed from the inner core of the flameless candle. Other flanges may be permanently affixed to their respective inner core and may be contiguous with the inner core.

Figure 6:
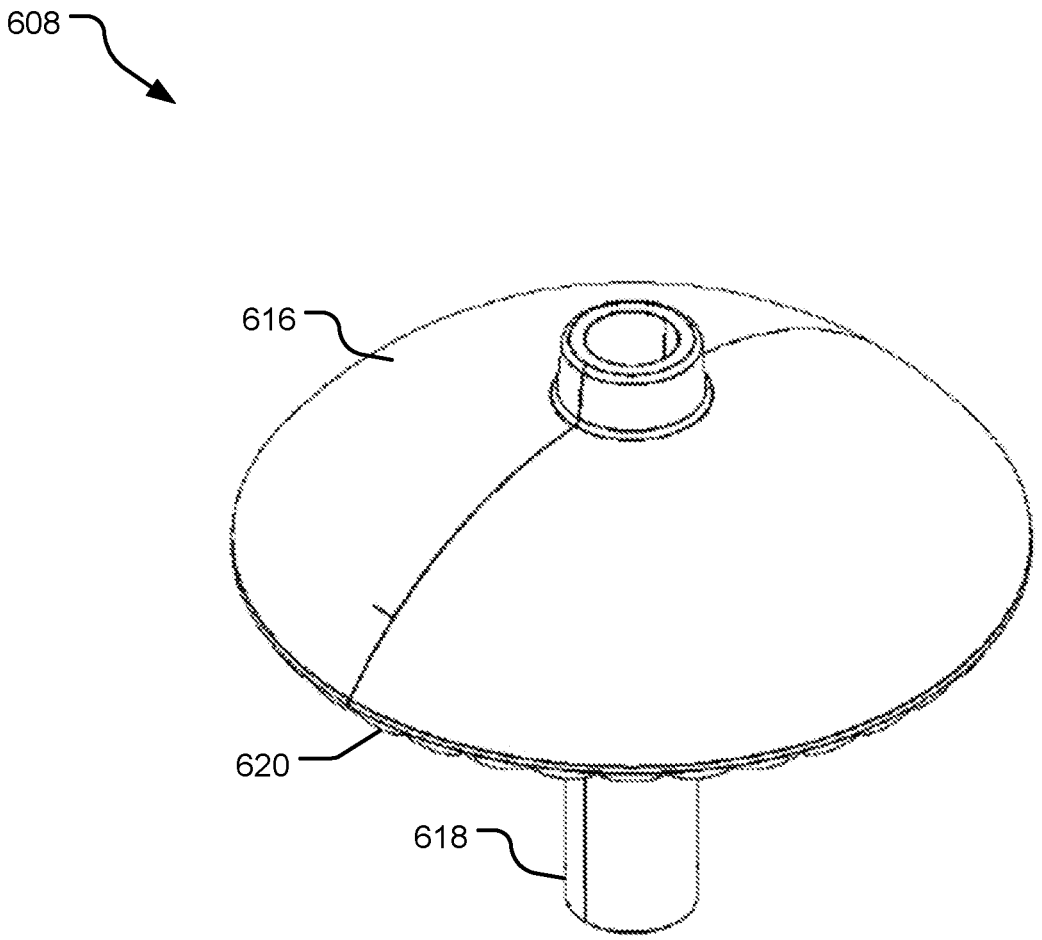
FIG. 6 illustrates a perspective view of an example serrated dome for use in a flameless candle with an integrated fountain.

FIG. 6 illustrates a perspective view of an example serrated dome 608 for use in a flameless candle with an integrated fountain. The serrated dome 608 includes an upper portion 616 and a conduit 618. The conduit 618 attaches to a pump outlet within the removable core, such that water leaving the pump outlet travels through the conduit 618 of the serrated dome 608 and over the upper portion 616 of the serrated dome 608. In some implementations, the serrated dome 608 is permanently attached to the removable core. In other implementations, the serrated dome 608 is removably attached to the pump outlet, such that different serrated domes may be used in the same removable core. The removable serrated dome 608 allows a user to change the look of the removable core by using a serrated dome of a different color or material. The user may also change the overall effect of the flameless candle with integrated fountain by choosing a serrated dome 608 that produces more or fewer individual streams of water when water flows over the upper portion 616 of the serrated dome 608.

A bottom edge 620 of the upper portion 616 of the serrated dome 608 is serrated. The serrated bottom edge 620 causes water flowing over the upper portion 616 of the serrated dome 608 to flow in multiple streams guided by the serrated bottom edge 620. Though the serrated bottom edge is shown as a semi-circular pattern on the bottom edge 620 of the upper portion 616 of the serrated dome 608, other patterns may be used on the bottom edge 620 of the upper portion 616 of the serrated dome 608. For example, the bottom edge 620 of the upper portion 616 of the serrated dome 608 may be, for example, cut in a sawtooth pattern, a scalloped pattern, or another pattern. Further, the serrated bottom edge 620 may have different patterns that create more or fewer streams of water flowing over the serrated dome 608.

The serrated dome 608 may be made from a variety of materials, including, without limitation, plastic, ceramic, or metal. In one implementation, the serrated dome 608 is made from transparent or translucent plastic. The transparent or translucent plastic allows for LED lights within the flameless candle with an integrated fountain to light up the water flowing over the serrated dome 608. When the serrated dome 608 is made from plastic, it may be manufactured using traditional molding methods. The serrated dome 608 may also be manufactured from pressed or molded non-combustible fiber.

The upper portion 616 of the serrated dome 608 is shown as a convex dome. In other implementations, the upper portion 616 of the serrated dome 608 may be shaped differently. For example, the upper portion 616 of the serrated dome 608 may be, for example and without limitation, a concave dome or a flat disk.

As shown in FIG. 6, the upper portion 616 of the serrated dome 608 has a smooth surface. In other implementations, the surface of the upper portion 616 of the serrated dome 608 may be textured to alter the flow of the water flowing over the upper portion 616 of the serrated dome 608. For example, the upper portion 616 of the serrated dome 608 may include etching, divots, or raised portions to alter the flow of the water.

Figure 7:
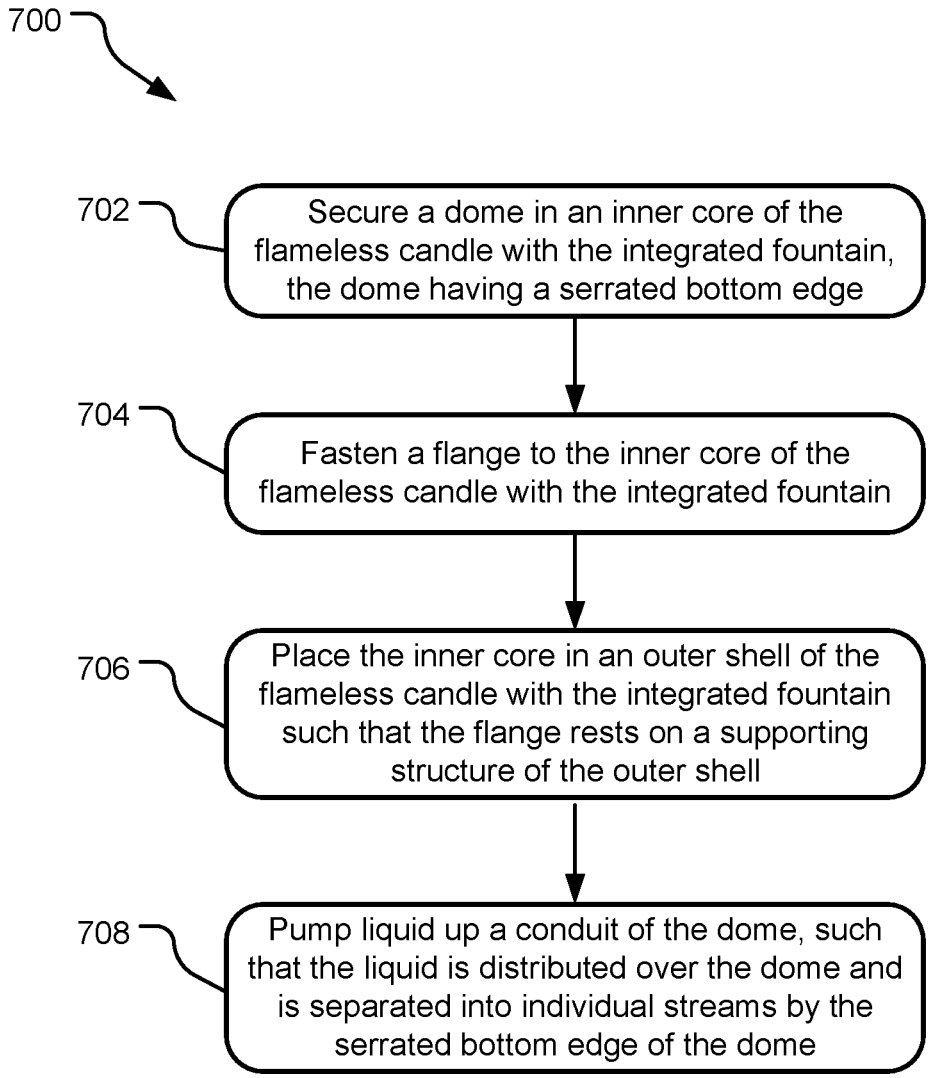
FIG. 7 illustrates example operations for use of a flameless candle with an integrated fountain.

FIG. 7 illustrates example operations for use of a flameless candle with an integrated fountain. A securing operation 702 secures a dome in a removable core of the flameless candle with the integrated fountain. The dome has a serrated bottom edge. The dome includes a conduit and an upper portion, such that water flows through the conduit and over the upper portion of the dome. The conduit is attached to an outlet of a submersible pump located in the removeable core of the flameless candle with the integrated fountain. The conduit may be secured to the outlet of the submersible pump in many ways. For example, in one implementation, the conduit snaps onto the outlet of the submersible pump. In another implementation, the conduit may include threads such that the dome screws into the removable core of the flameless candle with the integrated fountain. Further, in some implementations, the top of the conduit may include a grip to make it easier to secure the dome in the removable core of the flameless candle with the integrated fountain.

In some implementations, the upper portion of the dome is permanently attached to the conduit. In other implementations, the upper portion of the dome is not permanently attached to the conduit and assembly of the flameless candle with the integrated fountain includes securing the upper portion of the dome to the conduit. When the upper portion of the dome is not permanently attached to the conduit of the dome, the upper portion of the dome may be easily interchangeable to provide different effects for the flameless candle with the integrated fountain. For example, changing the upper portion of the dome could change the color of the removable core viewed from the top. In other implementations, changing the upper portion of the dome could change the pattern of the water flowing over the dome. For example, the serrated edges of different domes may cause more or fewer individual streams of water when water flows over the upper portion of the dome.

A fastening operation 704 fastens a flange to the removable core of the flameless candle with the integrated fountain. The flange may be fastened to the core using a variety of fastening methods. For example, in one implementation, the flange is screwed onto the removable core of the flameless candle with the integrated fountain. In other implementations, the flange may be attached using, for example and without limitation, snaps, a bayonet type fastener, or a cantilever fastener.

A placing operation 706 places the removable core in an outer shell of the flameless candle with the integrated fountain such that the flange rests on a supporting structure (e.g., a top portion of the outer shell or an inner ring protruding from an interior of the outer shell). The flange is placed such that the removable core is suspended within the outer shell. The flange may be a variety of shapes to accommodate differently shaped outer shells. For example, the flange shown may be circular to accommodate a cylindrical outer shell. In another implementation, the flange may be, for example, an oval shape to accommodate an outer shell with an oval cross-section. Further, the outer portion of the flange may vary in size to accommodate a larger or smaller outer shell. For example, the outer portion may have a larger outer diameter when the outer shell has a larger diameter. When the flange is removable from the inner core, differently sized or shaped flanges may be used so that the same core may fit in multiple outer shells of different sizes and shapes. The outer portion of the flange may be tapered or non-tapered.

A pumping operation 708 pumps liquid up a conduit of the dome, such that the liquid is distributed over the dome and is separated into individual streams by the serrated bottom edge of the dome. The submersible pump pumps liquid located in the upper reservoir of the flameless candle with the integrated fountain and pumps the liquid up the conduit of the dome. The liquid is then distributed over the surface of the dome. The serrated bottom edge of the dome separates the liquid into individual streams as it returns to the upper reservoir of the flameless candle with the integrated pump.

The operations described herein may be performed in any order, adding or omitting as desired unless explicitly claimed otherwise or a specific order is inherently necessitated by the claim language.

What is claimed is:

1. A method for using a flameless candle with an integrated fountain, the method comprising:

securing a dome in a removable core of the flameless candle with the integrated fountain, the dome having a serrated bottom edge;

fastening a flange to the removable core, the dome spaced from the flange to provide a concentric flow path for liquid to flow from a center of the upper portion of the dome over the serrated bottom edge of the dome; and placing the removable core in a supporting structure of the flameless candle with the integrated fountain such that the flange rests on the supporting structure.

2. The method of claim 1, wherein the removable core is divided into an upper reservoir and a lower reservoir.

3. The method of claim 2 further comprising:

filling the upper reservoir with water.

4. The method of claim 2, wherein the lower reservoir includes a power module, the power module including batteries.

5. The method of claim 1, wherein the flange includes a groove on a bottom surface thereof and the supporting structure is a top edge of an outer shell, wherein the top edge of the outer shell fits within the groove on the bottom surface of the flange.

6. The method of claim 1, wherein the supporting structure is an inner ring protruding from an interior of an outer shell, and wherein the flange fits within the outer shell and rests on the inner ring.

7. The method of claim 1, wherein an entirety of the bottom edge of the upper portion of the dome is serrated, further comprising:

pumping liquid up a conduit of the dome through a center of the dome such that the liquid is distributed over the dome and is separated into individual streams flowing concentrically around the center of the upper portion of the dome by the entirely serrated bottom edge of the dome.

8. The method of claim 1, wherein securing the dome in the core of the flameless candle with the integrated fountain includes securing an upper portion of the dome to a conduit of the dome.

9. The method of claim 1, wherein the flange is fastened to the removable core using a screw mechanism.

10. The method of claim 1, wherein securing the dome in the removable core includes securing a conduit of the dome to an outlet of a liquid pump located in the removable core.

11. A flameless candle with an integrated fountain comprising:

a supporting structure; and a core removably connected to the supporting structure, the core comprising:

a flange to rest on the supporting structure, a dome including an upper portion having a serrated bottom edge, the dome spaced from the flange to provide a concentric flow path for liquid to flow from a center of the upper portion of the dome over the serrated bottom edge of the dome, a liquid pump to pump the liquid upward through a center of the dome to the upper portion, and a light source.

12. The flameless candle with the integrated fountain of claim 11, wherein the flange includes a groove on a bottom surface thereof and the supporting structure is a top edge of an outer shell, wherein the top edge of the outer shell fits within the groove on the bottom surface of the flange.

13. The flameless candle with the integrated fountain of claim 11, wherein the supporting structure is an inner ring protruding from an interior of an outer shell, and wherein the flange fits within the outer shell and rests on the inner ring.

14. The flameless candle with the integrated fountain of claim 11, wherein the removable core is divided into an upper compartment and a lower compartment.

15. The flameless candle with the integrated fountain of claim 11, wherein the flange includes a raised lip about its inner perimeter that acts as a splash guard.

16. The flameless candle with the integrated fountain of claim 11, wherein an entirety of the bottom edge of the upper portion of the dome is serrated to separate liquid flowing over the upper portion of the dome into individual streams flowing concentrically around the center of the upper portion of the dome.

17. The flameless candle with the integrated fountain of claim 11, wherein the dome further includes a conduit attached to an outlet of the liquid pump.

18. A flameless candle with an integrated fountain comprising:

an outer shell; and a removable core removably connected to the outer shell, the removable core being divided into an upper reservoir and a lower reservoir, the removable core comprising:

a flange configured to rest on a top portion of the outer shell such that the removable core is suspended within the outer shell, a dome including an upper portion having a serrated bottom edge and a conduit attached to an outlet of a liquid pump located in the upper reservoir of the removable core, the dome spaced from the flange to provide a concentric flow path for liquid to flow from a center of the upper portion of the dome over the serrated bottom edge of the dome, a light source located in the upper compartment, and a power module located in the lower compartment.

19. The flameless candle with the integrated fountain of claim 18, wherein the flange includes a raised lip about its inner perimeter that acts as a splash guard.

20. The flameless candle with the integrated fountain of claim 18, wherein an entirety of the bottom edge of the upper portion of the dome is serrated to separate liquid flowing over the upper portion of the dome into individual streams flowing concentrically around the center of the upper portion of the dome.

* * * * *